US009144717B2

(12) United States Patent
Franklin et al.

(10) Patent No.: US 9,144,717 B2
(45) Date of Patent: Sep. 29, 2015

(54) PUTTER HEADS AND PUTTERS

(71) Applicant: NIKE, Inc., Beaverton, OR (US)

(72) Inventors: David N. Franklin, Granbury, TX (US); Andrew G. V. Oldknow, Beaverton, OR (US); Jason P. Martin, Lake Oswego, OR (US); Carl A. Jonsson, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 279 days.

(21) Appl. No.: 13/828,038

(22) Filed: Mar. 14, 2013

(65) Prior Publication Data

US 2013/0203522 A1 Aug. 8, 2013

Related U.S. Application Data

(63) Continuation-in-part of application No. 13/228,310, filed on Sep. 8, 2011, now Pat. No. 8,834,285, and a continuation-in-part of application No. 13/418,058, filed on Mar. 12, 2012, now Pat. No. 8,900,064.

(60) Provisional application No. 61/526,350, filed on Aug. 23, 2011.

(51) Int. Cl.
*A63B 53/04* (2015.01)
*A63B 53/06* (2015.01)
(Continued)

(52) U.S. Cl.
CPC ..... *A63B 53/007* (2013.01); *A63B 53/0487* (2013.01); *A63B 59/0092* (2013.01);
(Continued)

(58) Field of Classification Search
CPC ..... A63B 53/007; A63B 53/0487; A63B 2053/0429; A63B 59/0092; A63B 2053/042; A63B 2053/0425; A63B 2053/0433; A63B 2209/00; A63B 2053/0441
USPC ..... 473/324–350, 287–292, 251–256
See application file for complete search history.

(56) References Cited

U.S. PATENT DOCUMENTS 873,423 A 12/1907 Govan
1,289,553 A 12/1918 Sanders
(Continued)

FOREIGN PATENT DOCUMENTS

GB 2313552 A 12/1997
GB 2388792 A 11/2003
KR 20080047955 A 5/2008

OTHER PUBLICATIONS

International Search Report received in corresponding PCT Application No. PCT/US2010/031156 issued on Jul. 6, 2010.
(Continued)

*Primary Examiner* — Sebastiano Passaniti
(74) *Attorney, Agent, or Firm* — Banner & Witcoff, Ltd.

(57) ABSTRACT

A putter head has a putter body having a base member defining a ball striking face surface. The putter body further has a first arm extending away from the base member and a second arm extending away from the base member, and a central member extending away from the base member and positioned between the first arm and the second arm. A weight assembly is supported by the putter body. The weight assembly has a beam member having a first end, a second end and a central portion. The central portion is supported by the central member along a first plane, and the first end of the beam member is supported by the first arm along a second plane. The second plane is generally transverse to the first plane.

24 Claims, 5 Drawing Sheets

(51) Int. Cl.

| | |
|---|---|
| ***A63B 69/36*** | (2006.01) |
| ***A63B 53/00*** | (2015.01) |
| *A63B 59/00* | (2015.01) |

(52) U.S. Cl.

CPC ... *A63B2053/042* (2013.01); *A63B 2053/0425* (2013.01); *A63B 2053/0429* (2013.01); *A63B 2053/0433* (2013.01); *A63B 2053/0441* (2013.01); *A63B 2209/00* (2013.01)

(56) References Cited

U.S. PATENT DOCUMENTS

| | | | | | |
|---|---|---|---|---|---|
| D58,209 | S | | 6/1921 | Bacheller | |
| 2,005,401 | A | | 6/1935 | Storz | |
| 2,429,351 | A | | 10/1947 | Fetterolf | |
| 2,517,245 | A | | 8/1950 | Scott | |
| 2,859,972 | A | | 11/1958 | Reach | |
| 2,934,347 | A | | 4/1960 | Siniscalchi | |
| 2,957,696 | A | | 10/1960 | Warpotas | |
| 3,220,733 | A | * | 11/1965 | Saleeby | 473/335 |
| D205,041 | S | | 6/1966 | Capps | |
| D210,033 | S | | 1/1968 | Johnston | |
| 3,374,027 | A | | 3/1968 | Jacobs | |
| 3,448,981 | A | | 6/1969 | Anweiler | |
| 3,459,426 | A | | 8/1969 | Sherwood | |
| 3,695,618 | A | | 10/1972 | Woolley et al. | |
| 3,966,210 | A | | 6/1976 | Rozmus | |
| 3,979,125 | A | | 9/1976 | Lancellotti | |
| 4,034,989 | A | | 7/1977 | Stewart | |
| 4,174,839 | A | | 11/1979 | Marrs | |
| 4,659,083 | A | | 4/1987 | Szczepanski | |
| 4,679,792 | A | | 7/1987 | Straza et al. | |
| D327,931 | S | | 7/1992 | Stuff | |
| D327,932 | S | | 7/1992 | Stuff | |
| 5,230,509 | A | * | 7/1993 | Chavez | 473/336 |
| 5,248,145 | A | | 9/1993 | Brown | |
| 5,275,413 | A | * | 1/1994 | Sprague | 473/337 |
| 5,308,067 | A | * | 5/1994 | Cook | 473/341 |
| 5,354,059 | A | | 10/1994 | Stuff | |
| 5,358,249 | A | | 10/1994 | Mendralla | |
| 5,398,929 | A | | 3/1995 | Kitaichi | |
| 5,409,219 | A | | 4/1995 | Saksun, Sr. | |
| 5,497,993 | A | | 3/1996 | Shan | |
| 5,505,450 | A | | 4/1996 | Stuff | |
| 5,518,235 | A | | 5/1996 | Mendenhall | |
| 5,533,728 | A | | 7/1996 | Pehoski et al. | |
| 5,542,675 | A | | 8/1996 | Micciche et al. | |
| 5,620,379 | A | | 4/1997 | Borys | |
| 5,620,381 | A | | 4/1997 | Spalding | |
| 5,624,331 | A | | 4/1997 | Lo et al. | |
| 5,637,044 | A | | 6/1997 | Swash | |
| 5,655,976 | A | | 8/1997 | Rife | |
| 5,766,093 | A | | 6/1998 | Rohrer | |
| 5,769,737 | A | | 6/1998 | Holladay et al. | |
| 5,772,527 | A | | 6/1998 | Liu | |
| 5,807,190 | A | | 9/1998 | Krumme et al. | |
| D399,274 | S | | 10/1998 | Bradford | |
| 5,820,481 | A | * | 10/1998 | Raudman | 473/313 |
| D405,137 | S | | 2/1999 | Nelson | |
| 5,924,938 | A | * | 7/1999 | Hines | 473/307 |
| 5,944,619 | A | | 8/1999 | Cameron | |
| 5,947,841 | A | | 9/1999 | Silvestro | |
| 5,972,144 | A | | 10/1999 | Hsu | |
| 6,059,669 | A | | 5/2000 | Pearce | |
| 6,093,116 | A | | 7/2000 | Hettinger et al. | |
| 6,200,229 | B1 | | 3/2001 | Grace et al. | |
| 6,244,974 | B1 | | 6/2001 | Hanberry, Jr. | |
| 6,302,807 | B1 | | 10/2001 | Rohrer | |
| 6,309,310 | B1 | | 10/2001 | Shira | |
| 6,334,818 | B1 | | 1/2002 | Cameron et al. | |
| 6,348,014 | B1 | | 2/2002 | Chiu | |
| 6,350,208 | B1 | | 2/2002 | Ford | |
| 6,379,258 | B1 | | 4/2002 | To | |
| D460,990 | S | | 7/2002 | Jung | |
| 6,431,997 | B1 | | 8/2002 | Rohrer | |
| 6,488,595 | B1 | | 12/2002 | Grace | |
| 6,517,450 | B1 | | 2/2003 | Klyve | |
| 6,558,272 | B2 | | 5/2003 | Helmstetter et al. | |
| 6,652,390 | B2 | | 11/2003 | Bradford | |
| 6,699,140 | B1 | * | 3/2004 | Sun | 473/252 |
| 6,716,110 | B1 | | 4/2004 | Ballow | |
| 6,893,355 | B2 | | 5/2005 | Souza et al. | |
| 6,921,343 | B2 | | 7/2005 | Solheim | |
| 6,932,716 | B2 | | 8/2005 | Ehlers et al. | |
| D513,050 | S | | 12/2005 | Grimaldo | |
| 6,988,956 | B2 | * | 1/2006 | Cover et al. | 473/244 |
| 7,018,304 | B2 | | 3/2006 | Bradford | |
| D520,584 | S | | 5/2006 | Karlsen | |
| 7,166,039 | B2 | | 1/2007 | Hettinger et al. | |
| 7,175,537 | B2 | | 2/2007 | Pollman | |
| 7,182,697 | B2 | | 2/2007 | Zamora | |
| 7,261,644 | B2 | | 8/2007 | Burrows | |
| 7,278,926 | B2 | | 10/2007 | Frame | |
| 7,281,990 | B2 | | 10/2007 | Hagood et al. | |
| 7,371,184 | B2 | | 5/2008 | Tao | |
| 7,407,443 | B2 | | 8/2008 | Franklin et al. | |
| 7,491,131 | B2 | | 2/2009 | Vinton | |
| D588,222 | S | | 3/2009 | Takahashi | |
| D600,298 | S | | 9/2009 | Serrano et al. | |
| D600,762 | S | | 9/2009 | Serrano et al. | |
| 7,594,862 | B2 | | 9/2009 | Gilbert | |
| 7,594,863 | B2 | | 9/2009 | Ban | |
| D605,242 | S | | 12/2009 | Franklin et al. | |
| 7,648,425 | B2 | | 1/2010 | Wahl et al. | |
| D615,140 | S | | 5/2010 | Franklin et al. | |
| 7,717,801 | B2 | | 5/2010 | Franklin et al. | |
| 7,758,449 | B2 | | 7/2010 | Gilbert et al. | |
| 7,780,549 | B2 | | 8/2010 | Park et al. | |
| 7,794,333 | B2 | | 9/2010 | Wallans et al. | |
| 7,806,779 | B2 | | 10/2010 | Franklin et al. | |
| 7,841,952 | B1 | | 11/2010 | Oldknow et al. | |
| 7,846,039 | B2 | | 12/2010 | Gilbert et al. | |
| 7,862,449 | B2 | | 1/2011 | Stites et al. | |
| 7,867,104 | B2 | | 1/2011 | Franklin et al. | |
| 7,927,230 | B2 | | 4/2011 | Solheim | |
| 7,942,757 | B2 | | 5/2011 | Blumenkrantz et al. | |
| 8,012,035 | B2 | | 9/2011 | Franklin et al. | |
| 8,062,146 | B2 | | 11/2011 | Franklin et al. | |
| 8,063,605 | B2 | | 11/2011 | Tonegawa et al. | |
| 8,066,581 | B2 | | 11/2011 | Ines et al. | |
| 8,083,605 | B2 | | 12/2011 | Franklin et al. | |
| 8,083,611 | B2 | | 12/2011 | Kuan et al. | |
| 8,210,962 | B2 | | 7/2012 | Franklin et al. | |
| 8,216,081 | B2 | | 7/2012 | Snyder et al. | |
| 8,292,754 | B2 | | 10/2012 | Snyder et al. | |
| 8,480,504 | B2 | | 7/2013 | Hilton et al. | |
| 8,506,415 | B2 | | 8/2013 | Franklin | |
| 8,517,852 | B1 | | 8/2013 | Hilton et al. | |
| 8,550,931 | B1 | | 10/2013 | Hilton et al. | |
| 2003/0013546 | A1 | | 1/2003 | Bradford | |
| 2004/0242342 | A1 | | 12/2004 | Patten | |
| 2005/0009623 | A1 | | 1/2005 | Dickinson | |
| 2005/0137027 | A1 | | 6/2005 | Thomas | |
| 2005/0209020 | A1 | | 9/2005 | Burrows | |
| 2005/0215354 | A1 | | 9/2005 | Kumamoto | |
| 2005/0233829 | A1 | | 10/2005 | Cameron | |
| 2005/0277487 | A1 | | 12/2005 | Takeda | |
| 2006/0052178 | A1 | * | 3/2006 | Franklin et al. | 473/340 |
| 2006/0128498 | A1 | * | 6/2006 | Reese | 473/340 |
| 2006/0223649 | A1 | * | 10/2006 | Rife | 473/334 |
| 2007/0037632 | A1 | | 2/2007 | Jorgensen | |
| 2007/0142122 | A1 | | 6/2007 | Bonneau | |
| 2007/0161430 | A1 | | 7/2007 | Bardha | |
| 2007/0191135 | A1 | * | 8/2007 | Nilsson et al. | 473/340 |
| 2007/0225085 | A1 | * | 9/2007 | Koide et al. | 473/340 |
| 2007/0243949 | A1 | | 10/2007 | Solari | |
| 2007/0265109 | A1 | * | 11/2007 | Elmer | 473/340 |
| 2008/0125241 | A1 | | 5/2008 | Tateno et al. | |
| 2008/0153623 | A1 | | 6/2008 | Ines | |
| 2008/0207351 | A1 | | 8/2008 | Wallans et al. | |
| 2008/0293511 | A1 | | 11/2008 | Gilbert | |
| 2008/0293513 | A1 | | 11/2008 | Bitko et al. | |
| 2009/0105008 | A1 | | 4/2009 | Kuan et al. | |
| 2009/0131197 | A1 | | 5/2009 | Miyamichi | |

(56) References Cited

U.S. PATENT DOCUMENTS

| | | | | |
|---|---|---|---|---|
| 2009/0149271 | A1 | 6/2009 | Nakamura | |
| 2009/0286620 | A1 | 11/2009 | Franklin et al. | |
| 2009/0286621 | A1 | 11/2009 | Franklin et al. | |
| 2009/0305807 | A1 | 12/2009 | Solheim et al. | |
| 2010/0011184 | A1 | 1/2010 | Mimatsu et al. | |
| 2010/0087269 | A1 | 4/2010 | Snyder et al. | |
| 2010/0113179 | A1 | 5/2010 | Solheim | |
| 2010/0113184 | A1 | 5/2010 | Kuan et al. | |
| 2010/0133184 | A1 | 6/2010 | Gojo et al. | |
| 2010/0167835 | A1 | 7/2010 | Franklin et al. | |
| 2010/0234127 | A1 | 9/2010 | Snyder et al. | |
| 2010/0304878 | A1 | 12/2010 | Reichow et al. | |
| 2011/0034268 | A1 | 2/2011 | Franklin et al. | |
| 2011/0039633 | A1 | 2/2011 | Snyder et al. | |
| 2011/0070971 | A1 | 3/2011 | Franklin et al. | |
| 2011/0224014 | A1 * | 9/2011 | Tryner et al. | 473/251 |
| 2012/0184393 | A1 | 7/2012 | Franklin | |

OTHER PUBLICATIONS

European Search Report received in corresponding European Application No. 11159319.0 issued on Sep. 23, 2011.

International Search Report received in PCT Application No. PCt/US2010/051432 issued on Mar. 30, 2011.

Notice of Allowance received in corresponding U.S. Appl. No. 12/880,737 issued on Apr. 10, 2013.

Office Action received in corresponding U.S. Appl. No. 12/467,812 issued on Apr. 16, 2010.

Office Action received in corresponding U.S. Appl. No. 12/259,541 issued on Sep. 4, 2009.

C-Groove—Development, Harold Swash Putting School of Excellence, (Aug. 26, 2008), http://www.haroldswashputting.co.uk/haroldswash_development.htm.

Rife Two Bar Hybrid Putter Review, Putter Zone Golf, (Mar. 7, 2008), http://www.putterzone.com/2008/03/rife-twobar-hybrid-putter-review.html.

International Search Report received in corresponding PCT application No. PCT/US2009/044331 issued on Sep. 10, 2009.

Office Action received in corresponding U.S. Appl. No. 12/906,901 issued on Sep. 23, 2011.

International Search received in corresponding PCT Application No. PCT/US2011/028674 issued on Jul. 18, 2011.

Office Action received in corresponding U.S. Appl. No. 12/870,714 issued on Dec. 7, 2010.

Office Action received in corresponding U.S. Appl. No. 12/880,737 issued on Jan. 3, 2013.

Office Action received in corresponding U.S. Appl. No. 12/907,781 issued on Feb. 1, 2012.

* cited by examiner

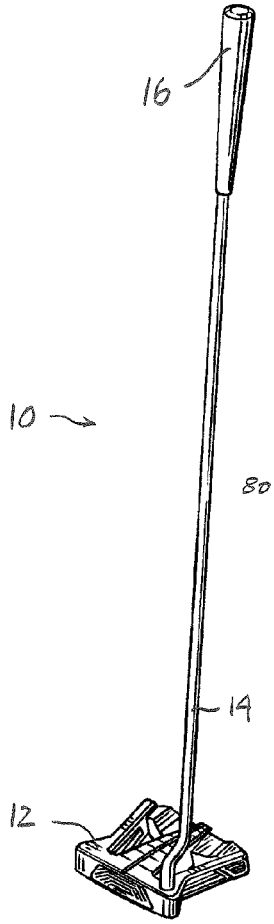
FIG. 1
FIG. 2
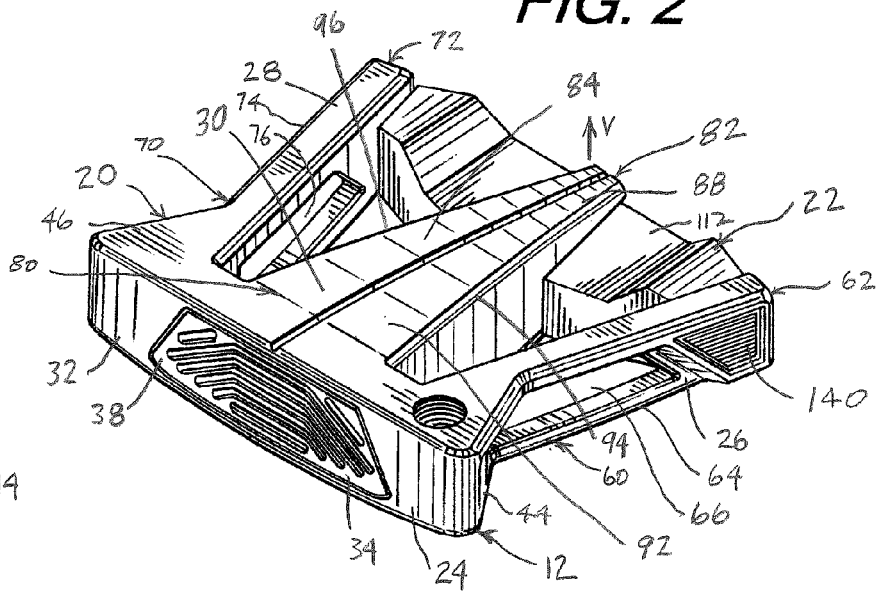
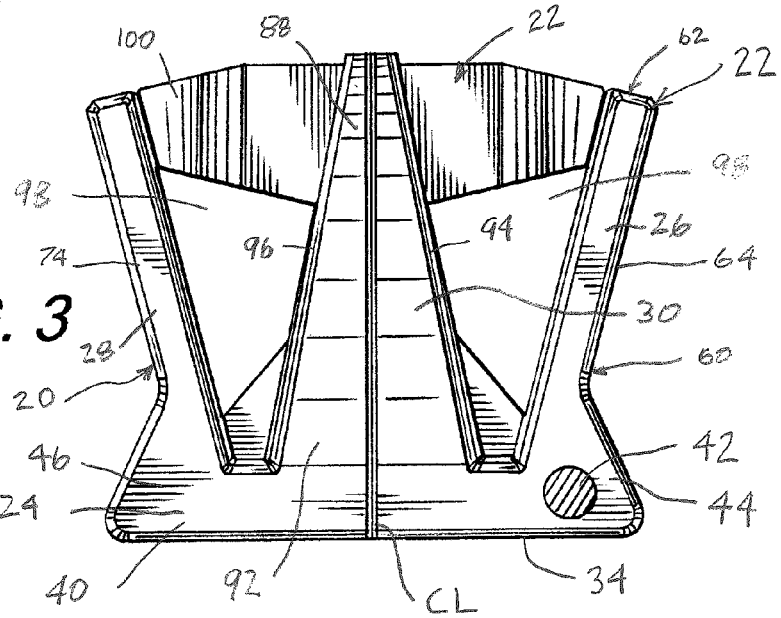
FIG. 3

PUTTER HEADS AND PUTTERS

RELATED APPLICATION INFORMATION

This application is a continuation-in-part application of, and claims priority to, U.S. patent application Ser. No. 13/228,310 filed on Sep. 8, 2011, which claims the benefit of U.S. Provisional Patent Application No. 61/526,350 filed on Aug. 23, 2011, and this application is also a continuation-in-part application of, and claims priority to, U.S. patent application Ser. No. 13/418,058 filed on Mar. 12, 2012, which applications are entirely incorporated herein by reference and made a part hereof.

FIELD OF THE INVENTION

The invention relates generally to putter heads and putters. Putter heads and putters in accordance with at least some examples of this invention may have a weight assembly and connection structures to provide enhanced structural configurations and performance characteristics.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well known golf superstars, at least in part, have increased golf's popularity in recent years both in the United States and across the world.

Golfers at all skill levels seek to improve their performance, lower their golf scores, and reach that next performance "level." Manufacturers of all types of golf equipment have responded to these demands, and recently, the industry has witnessed dramatic changes and improvements in golf equipment. For example, a wide range of different golf ball models now are available, with some balls designed to complement specific swing speeds and/or other player characteristics or preferences, e.g., with some balls designed to fly farther and/or straighter, some designed to provide higher or flatter trajectories, some designed to provide more spin, control, and/or feel (particularly around the greens), etc. A host of swing aids and/or teaching aids also are available on the market that promise to help lower one's golf scores.

Being the sole instruments that set golf balls in motion during play, golf clubs also have been the subject of much technological research and advancement in recent years. For example, the market has seen improvements in putter designs, golf club head designs, shafts, and grips in recent years. Additionally, other technological advancements have been made in an effort to better match the various elements and/or characteristics of the golf club and/or characteristics of a golf ball to a particular user's swing features or characteristics (e.g., club fitting technology, ball launch angle measurement technology, ball spin rate characteristics, etc.).

Golfers tend to be sensitive to the "feel" of a golf club, particularly with respect to putters. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, and the like all may affect the "feel" of the club as it swings and strikes a ball. "Feel" also has been found to be related to the visual appearance of the club and the sound produced when the club head strikes a ball to send the ball in motion.

To successfully putt a ball in the hole, the ball must be launched at the proper combination of speed and direction to arrive at the intended destination. While some errors in putt speed and direction may be the result of mental or physical mistakes by the player (e.g., mis-hits, mis-alignment, etc.), the putter also can contribute to inconsistencies in ball launch speed and launch direction that result in missed putts. For example, if the putter head twists in the player's hands before or during ball contact, this may cause the ball to start out "off-line," with some undesired spin and/or at the wrong speed. As another example, if the ball is launched with backspin or bounces excessively during the early phase of its locomotion, this can cause inconsistencies in ball speed. All of these things may result in missed putts and inconsistent putting.

While technological improvements to putter designs have been made, because of the very personal nature of the putting stroke and the "feel" aspects of putting a golf ball, no single putter structure is best suited for all players. New putter structures that provide enhance weighting configurations while maintaining a desired look and feel of the club are desired by at least some players. Moreover, technological advances that provide improved and more consistent ball initial launch direction and launch speed would be a welcome advance in the art.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to putters and putter heads that include one or more of the following: (a) a main putter body portion including a base member, a first arm, a second arm and a central member; (b) a weight assembly having a plurality of weight members associated therewith; (c) the base member having a ball striking face surface engaged with or integrally formed as part of the main putter body portion, the ball striking face surface including a portion for contacting a ball during a putting stroke, wherein the ball striking face surface includes a plurality of openings defined therein; (e) a polymeric material associated with the base member and ball striking face surface, wherein a portion of the polymeric material is exposed at an exterior surface of the ball striking face surface through the plurality of openings; and/or (f) a shaft engaged with the putter head (e.g., with at least one of the main putter body portion or the ball striking face member). The weight elements associated with the weight assembly are provided to help control the weighting characteristics of the putter head and/or to dampen or attenuate vibration (e.g., when a ball is struck). If desired, a hosel for engaging the shaft may be provided on the main putter body portion. Putter heads in accordance with examples of this aspect of the invention may have various additional features or structures, e.g., relating to weighting features, alignment aid features, putter head constructions or parts, polymeric material exposure features, groove features, etc., as described in more detail below.

According to another aspect of the invention, a putter head has a putter body having a base member defining a ball striking face surface. The putter body further has a first arm extending away from the base member and a second arm extending away from the base member. The putter body further has a central member extending away from the base member and positioned between the first arm and the second arm. A weight assembly is supported by the putter body. The weight assembly has a beam member having a first end and a second end. The beam member further has a central portion that is supported by the central member along a first plane. The first end of the beam member is supported by the first arm along a second plane, the second plane being generally transverse to the first plane.

According to a further aspect of the invention, the first plane is a generally vertical plane when the putter head is at a ball address position. The second plane is generally a horizontal plane when the putter head is at the ball address position.

According to another aspect of the invention, the central member defines a C-shaped channel. The central portion of the beam member is received in the C-shaped channel. The central member may have a first segment and a second segment that define a space therebetween. The central portion is received in the space. The first segment may be positioned against a bottom surface of the beam member and the second segment may be positioned against a top surface of the beam member. The central portion may be received in the space in an interference fit between the first segment and the second segment. The central member may also have a wall extending between the first segment and the second segment. The beam member has a receptacle having a weight member therein, wherein the weight member confronts the wall.

According to a further aspect of the invention, a bottom surface of the beam member has a recess proximate the central portion. The first segment is received in the recess wherein edges defined by the recess and edges defined by the first segment are generally flush with one another.

According to further aspects of the invention, the second end of the beam member is supported by the second arm along the second plane. The first arm has a first opening at a distal end and extends along the second plane. The second plane is a generally horizontal plane when the putter head is at a ball address position. The second arm has a second opening at a distal end and extending along the second plane. The beam member has a first opening at the first end extending along the second plane. The beam member also has a second opening at the second end extending along the second plane. A first fastener is received through the first opening of the first arm and the first opening of the beam member along the second plane. A second fastener is received through the second opening of the second arm and the second opening of the beam member along the second plane.

According to additional aspects of the invention, the first arm defines a first platform around the first opening and the second arm defines a second platform around the second opening. A first badge member is positioned over the first fastener on the first platform, and a second badge member positioned over the second fastener on the second platform.

According to further aspects of the invention, the weight assembly has weight members associated therewith. The beam member may have a receptacle, and a weight member is received in the receptacle. The beam member may have a central receptacle, a first receptacle adjacent the central receptacle and a second receptacle adjacent the central receptacle opposite from the first receptacle. A central weight member is positioned in the central receptacle, a first weight member is positioned in the first receptacle and a second weight member is positioned in the second receptacle. The central weight member may be received in the central receptacle from a front segment of the beam member. The first weight member may be received in the first receptacle from a bottom surface of the beam member, and the second weight member may be received in the second receptacle from the bottom surface of the beam member. The first receptacle and the first weight member may have mating threads to secure the first weight member in the first receptacle. The second receptacle and the second weight member may have mating threads to secure the second weight member in the second receptacle.

According to another aspect of the invention, the putter head has a weight value and the weight assembly has a weight value that is approximately 50%-60% of the weight value of the putter head.

According to a further aspect of the invention, the base member has a recess wherein the recess receives a ball striking face insert. The insert has a front portion formed of a metal material and having a plurality of spaced apart openings formed in the metal material. A backing material is engaged with the front portion, the backing material being formed of a polymer material. The polymer material extends into the openings wherein the metal material and polymer material form at least a portion of the ball striking face surface of the putter head.

According to further aspects of the invention, a center line is defined at the ball striking face surface. The first arm is configured to be angled towards the center line of the putter head such that the first arm defines a first line which, when extended, is tangent to a portion of an outside diameter of a golf ball when the golf ball is positioned in front of the ball striking face surface with the center of the golf ball aligned with the center line of the putter head. The second arm is configured to be angled towards the center line of the putter head such that the second arm defines a second line which, when extended, is tangent to a portion of an outside diameter of the golf ball when the golf ball is positioned in front of the ball striking face surface with the center of the golf ball aligned with the center line of the putter head. The first line extends linearly throughout the first arm along a linear center line of the first arm, and the second line extends linearly throughout the second arm along a linear center line of the second arm. The first line and the second line are symmetrical with respect to the center line of the putter head.

According to a further aspect of the invention, the putter body defines a center line at the ball striking face surface. The putter body further has a first structure defining a first pair of lines that, when extended to a position in front of the ball striking face surface, the lines are generally tangent to respective opposite portions of an outside diameter of the golf ball when the golf ball is positioned in front of the ball striking face surface with the center of the golf ball aligned with the center line of the putter head. The putter body further has a second structure defining a second pair of lines that, when extended, converge to a point in space behind the putter head that is aligned with the center line of the putter head.

According to further aspects of the invention, a putter head has a putter body and a weight assembly operably associated with the putter body. The weight assembly is connected to the putter body at a first location of the putter body and generally along a first direction. The weight assembly is connected to the putter body at a second location of the putter body and generally along a second direction, the second direction being generally transverse to the first direction. The putter body has a central member having a first segment and a second segment defining a space therebetween, wherein a central portion of the weight assembly is received in the space to define the connection at the first location. The first direction is generally vertical when the putter head is in a ball address position. The putter body has a first arm and a second arm, and the weight assembly has a first end and a second end. The first arm is connected to the first end of the weight assembly, and the second arm is connected to the second end of the weight assembly to define the second location and wherein the second direction is generally horizontal when the putter head is in a ball address position.

Putter heads in accordance with examples of this aspect of the invention may have various additional features or structures, e.g., relating to weighting features, alignment aid features, putter head constructions or parts, etc., as described in more detail below.

Additional aspects of this invention relate to methods for making putting devices, e.g., such as putters and putter heads of the types described above. Such methods will be described in more detail below.

BRIEF DESCRIPTION OF THE DRAWINGS

A more complete understanding of the present invention and certain advantages thereof may be acquired by referring to the following detailed description in consideration with the accompanying drawings, in which the same reference numbers indicate the same or similar features, and wherein:

FIG. 1 is a perspective view of a putter having a putter head and shaft in accordance with aspects of this invention;

FIG. 2 is a perspective view of a putter head of the putter of FIG. 1;

FIG. 3 is a top plan view of the putter head of FIG. 2;

DETAILED DESCRIPTION

Figure 4:
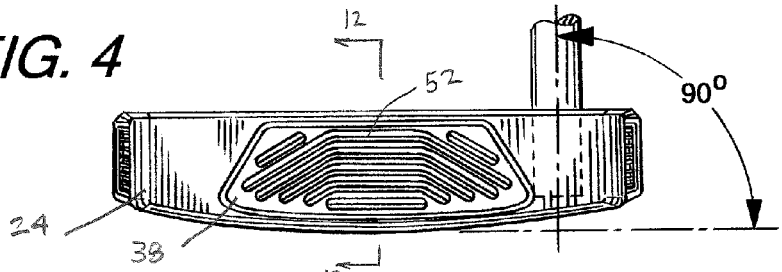
FIG. 4 is a front elevation view of the putter head of FIG. 2 and showing a portion of the shaft.

In the following description of various example putter heads and other aspects of this invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures and/or the orientations during typical use. Nothing in this specification should be construed as requiring a specific three dimensional orientation of structures in order to fall within the scope of this invention. In addition, use of the terms "first" and "second" etc. in describing the putters and putter heads of the invention may also be reversed.

At least some example aspects of this invention relate to putters and putter heads, as well as to methods of making such structures. A detailed description of specific examples of the invention is provided below. Along with such description, the various figures in this application illustrate examples of such putters and putter heads, components thereof, and methods in accordance with examples of this invention. When the same reference number appears in more than one drawing, that reference number is used consistently in this specification and the drawings to refer to the same or similar parts throughout.

FIG. 1 illustrates an example golf club in the form of a putter in accordance with this invention, the putter being designated with the reference numeral 10. The putter 10 generally includes a putter head 12 connected to a shaft 14. The putter head 12 will be described in greater detail below. The shaft 14 has a first end dimensioned to be received in an opening in the putter head 12. It is understood that the shaft 14 can be connected to the putter head 12 at various locations on the putter head 12. The shaft 14 has a distal end having a grip member 16 thereon. The shaft 14 may be made of any desired materials without departing from this invention, including, for example, metals, metal alloys, composites, polymeric members, polymeric members with associated coatings, and the like, including materials that are conventionally known and used in the art. It is further understood that the shaft 14 may fit into a hosel member associated with the putter head 12.

Putter Head

As further shown in FIGS. 2-8, the putter head 12 generally includes a putter body 20 and a weight assembly 22. As will be explained, the weight assembly 22 is supported by and separately connected to the putter body 20. The putter head 12 may be made from any desired materials without departing from this invention, including, for example, metals, metal alloys (such as aluminum and stainless steel), and the like, composites, polymeric materials and further including materials that are conventionally known and used in the art. A combination of materials could also be utilized.

Putter Body

The putter body 12 generally includes a base member 24, a first arm 26 and a second arm 28 extending away from the base member 24, and a central member 30 also extending away from the base member 24. The central member 30 is positioned between the first arm 26 and the second arm 28. It is understood that the putter body 12 could be formed as an integral member by mechanical processes readily known to those skilled in the art. The putter body 12 could also be formed of separate components that are connected together to form the putter body 12.

Figure 6:
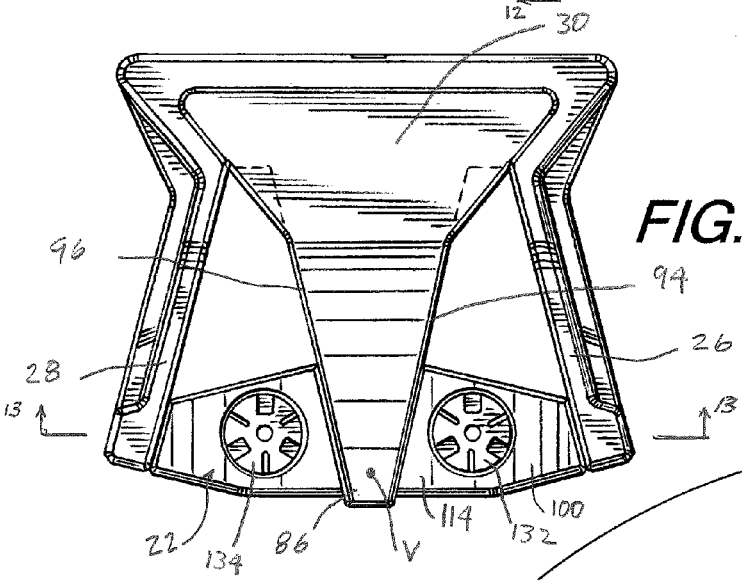
FIG. 6 is a bottom plan view of the putter head of FIG. 2.

The base member 24 is a block-like structure that has a front face 32 that defines a ball striking face surface 34. In one exemplary embodiment, the base member 24 has a recess 36 (FIGS. 7 and 12) therein. The recess 36 receives a separate ball striking face insert 38 wherein the insert 38 defines the ball striking face surface 34 in an exemplary embodiment. The insert 38 will be described in greater detail below. The base member 24 further has a generally planar bottom surface (FIG. 6).

Figure 5:
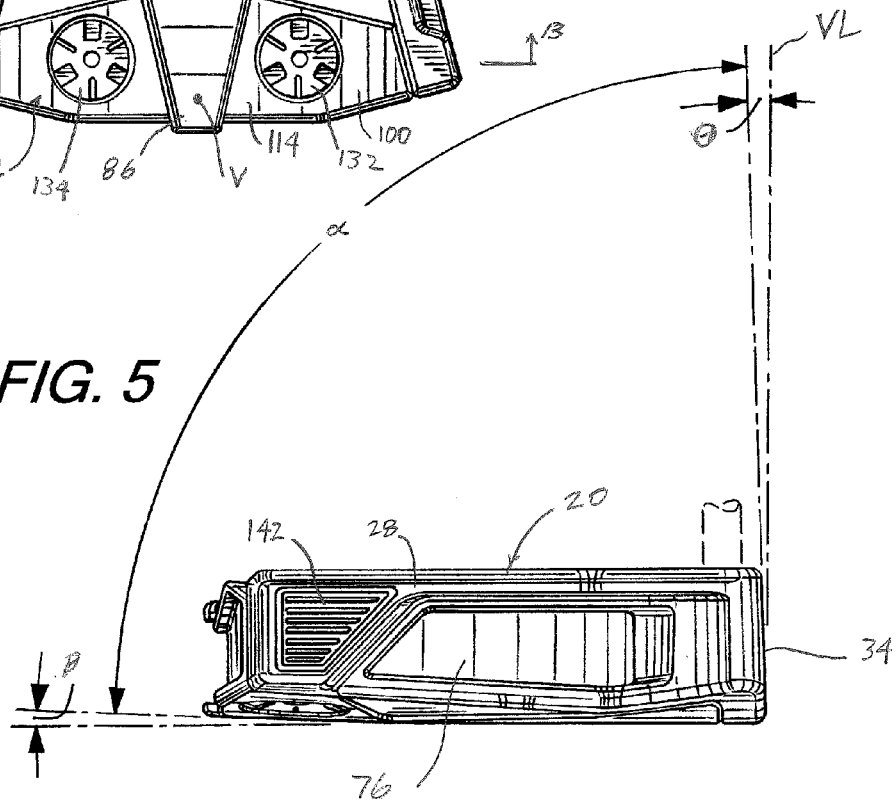
FIG. 5 is a side elevation view of the putter head of FIG. 2.

As further shown in FIG. 3, the base member 24 has a top surface 40 that is visible such as when the putter head 12 is at a ball address position (e.g., FIGS. 3-5). As explained in greater detail below, the top surface 40 defines a center line CL thereon that typically coincides with a center of the ball striking face surface 34. The center line CL may serve as an alignment aid marking on the top surface 40 of the base member 24. The base member 24 further has a bore 42 therein through the top surface 40 that receives the shaft 14. The base member 24 may utilize a hosel with the shaft 14 if desired. It is further understood that the bore 42 could be placed at various locations on the base member 24 or other locations on the putter body 12. While FIGS. 2-3 show the bore 42 at a location more suited for a right-handed golfer, the bore 42 could be located on an opposite side of the base member 24 such as a left-handed golfer.

The base member 24 further has a first flared portion 44 or first tapered portion 44 and a second flared portion 46 or second tapered portion 46. The first tapered portion 44 is proximate a heel of the putter head 12 and angles inwardly towards the central member 30. The second tapered portion 46 is proximate the toe of the putter head 12 and angles inwardly towards the central member 30. Thus, the first tapered portion 44 and the second tapered portion 46 angle towards one another such as to taper the width of the putter head 12 (when viewed from above). It is understood that the degree at which tapered portions angle inwardly can vary. Hence, the two flared or tapered portions 44,46 of the base member 24 may define opposite sides of the base member 24. Further, as seen in FIGS. 2 and 3, each of the tapered portions 44,46 of the base member 24 may define at least a portion of the sides of putter head 12.

Figure 7:
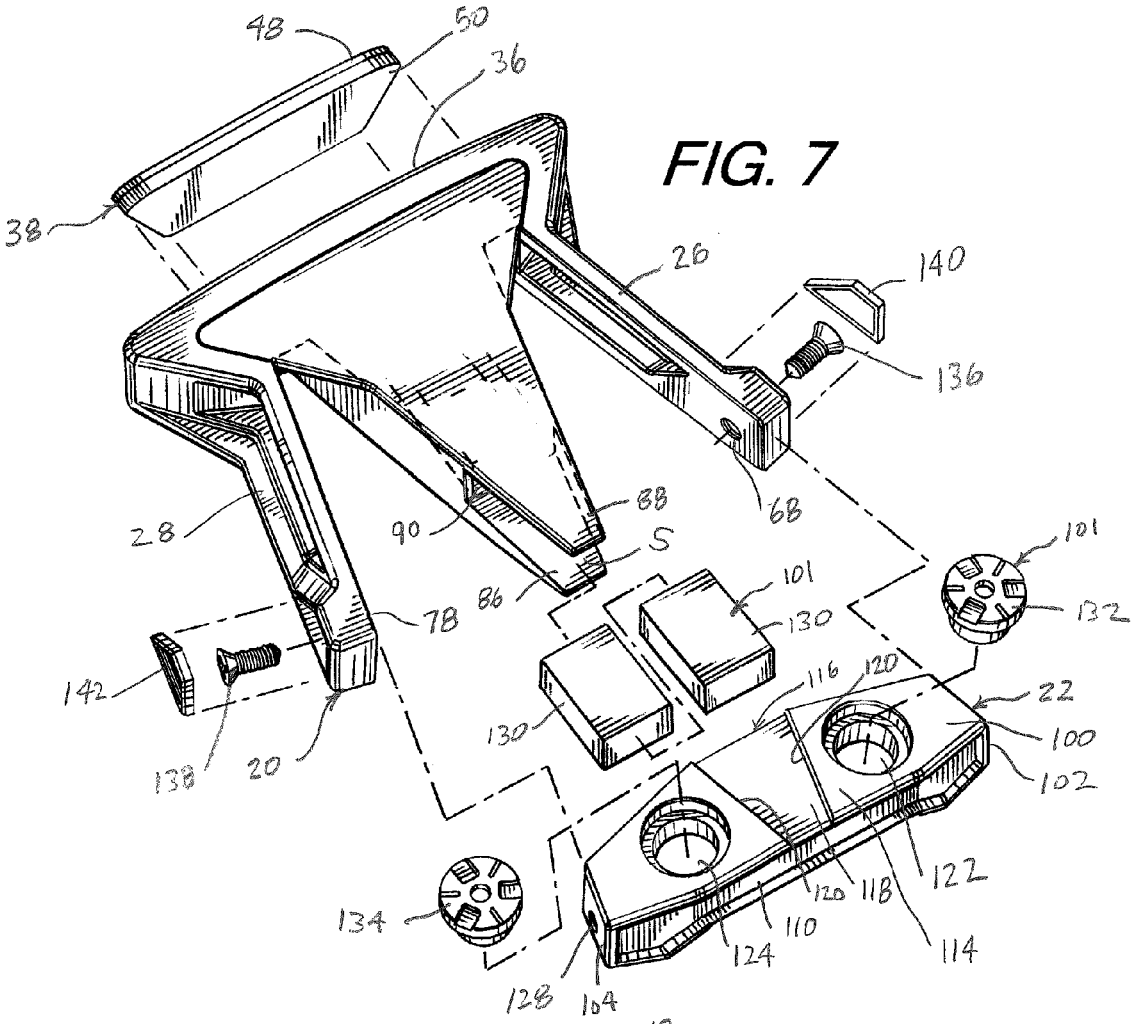
FIG. 7 is an exploded bottom plan view of the putter head of FIG. 2.
Figure 8:
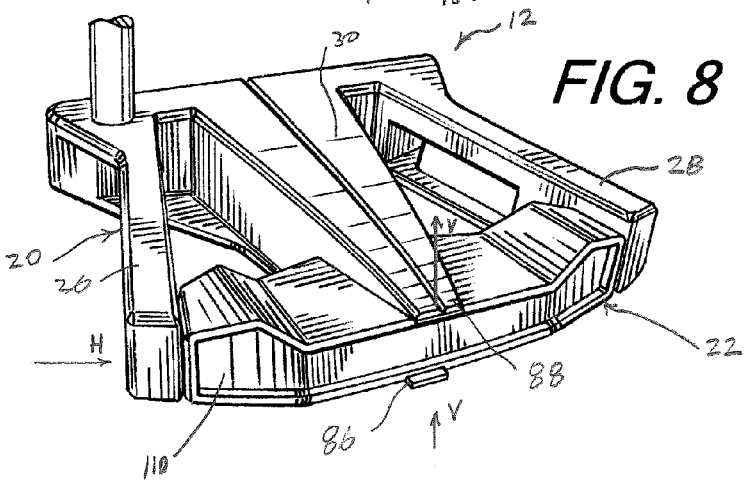
FIG. 8 is rear perspective view of the putter head of FIG. 2 and showing a portion of the shaft.
Figure 15:
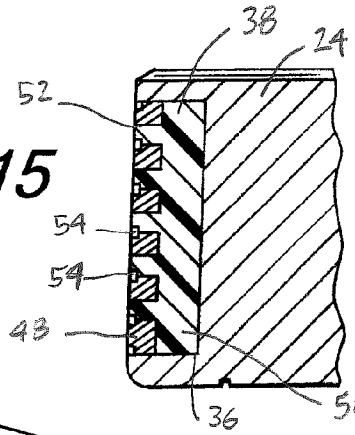
FIG. 15 is a partial cross-sectional view showing a face insert that defines a ball striking face surface and being connected to the putter body.

As discussed, and as further can be appreciated from FIGS. 4, 7 and 15, the ball striking face insert 38 is received in the recess 36 in the base member 24 to form the ball striking face surface 34. In an exemplary embodiment, the insert 38 has two distinct portions, namely a front plate portion 48 and a back plate portion 50. The front plate portion 48 is typically a metal material and the back plate portion 50 is typically a polymeric material. The metal material has a first hardness characteristic and the polymeric material has a second hardness characteristic that is generally softer than the first hardness characteristic. As shown in FIG. 15, the front plate portion 48 has a plurality of openings 52 (e.g., slots) formed therein. The openings 52 extend across the front plate portion 48 and may have generally horizontal segments and angled segments that spaced apart from one another. The openings 52 may be of any desired sizes, configurations, shapes, etc.

As further shown in FIGS. 2, 4 and 15, the ball striking face surface 34 includes the two distinct portions 48,50, namely, the portion made up of the material making the front plate portion 48 and the portion made from a polymeric material 50 as described above. The polymeric material portion 50 is filled into the openings 52 defined in the front plate portion 48 of the insert 38. The openings 52 may be formed in the front plate portion 48 in any desired manner without departing from this invention, including, for example, by forming the front plate portion 48 to include such openings 52 (e.g., during the molding, casting, forging, or other production process), by machining such openings 52 into the front plate portion 48 (e.g., punching or cutting them through a plate, etc.), etc. Any desired number of openings 52 may be provided in the front plate portion 48 without departing from this invention.

In some examples, the front plate portion 48 may be between 1 mm and 4 mm thick and, in some examples, may be approximately 2 or 3 mm thick. As mentioned, the plate 48 may include the openings 52 formed therein. The openings 52 typically extend completely through the plate 48 (i.e., forming one or more through holes in the plate 48). Alternatively, the openings 52 may extend partially through the plate 48 wherein polymer material can be positioned in the openings 52. Additionally or alternatively, the openings 52 may have a constant depth, width, height, etc. across the plate 48. However, in some examples, the depth, width, height, etc. of one or more openings 52 may vary along the length of the opening 52, along the plate 48, and the like. Additionally or alternatively, the openings 52, or at least some portion thereof, may be arranged generally horizontally across the ball striking surface 34 of the putter head 12 when the club is in a ball address position. In other arrangements, the openings 52 may extend in a non-horizontal linear, circular, semi-circular, or other curved pattern on the face.

Figure 12:
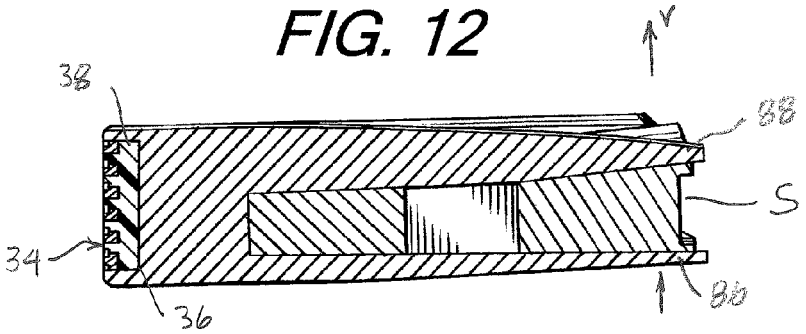
FIG. 12 is a cross-sectional view of the putter head taken along line 12-12 of FIG. 4.

As shown in FIGS. 12 and 15, the insert 38 may also incorporate a groove 54 or plurality of grooves associated with the front plate portion 48 and/or the back plate portion 50. The groove 54 may be associated with each opening 52. The grooves 54 assist in providing desired top spin of the golf ball upon impact by the putter head 12 during a putt. The grooves 54 can take various configurations and be positioned in one of the front plate portion 48, the back plate portion 50 or a combination of both portions. In one exemplary embodiment, one edge of the groove 54 could be made from metal material of the front plate portion 48 and another edge of the groove 54 could be made from polymeric material of the back plate portion 50. The insert 38 may further have structures, configurations and features such as described and disclosed in U.S. Pat. No. 8,216,081, which patent is expressly incorporated herein by reference.

One potential advantage of providing a polymeric material within a putter head relates to the potential for weight savings. By removing some of the metal material from the putter head body, such as at the front face of the base member, this material may be replaced by a lighter weight or less dense polymeric material. This weight savings allows the club designer to place additional weight at other areas of the putter head structure, such as toward the rear corners of the putter head structure, or just generally more towards the rear of the putter head structure. Such features may allow the club designer to control and design a club head having a higher moment of inertia (resistance to twisting) and desired center of gravity location characteristics. Additionally, by including this relatively soft polymeric material 50 as part of the ball striking surface 34 (such that the polymeric material 50 also directly contacts the ball during a putt) and in the putter head, the ball strike characteristics of the putter head may be altered and controlled, which affects the sound, rebound, and other "feel" characteristics of the putter head (e.g., by damping vibrations and altering the sound of a ball strike). The polymeric material 50 and/or the junction between the polymeric material 50*b* and the front plate portion 48 also may positively influence ball spin as the ball comes off the putter face.

As also illustrated in FIGS. 5 and 12, the ball striking face surface 34 may be generally smooth (e.g., the portions 48 and 50 may smoothly transfer from one portion to the next in the alternating portion structure). The ball striking face surface 34 may be flat, or it may include some roll or bulge characteristics, and/or it may have some desired loft characteristic. In this illustrated example, the ball striking face surface 34 will have a loft angle θ of 3° or less, and in some examples, the angle θ may be 2.5° or less or even 2° or less. In one exemplary embodiment, the loft angle θ is approximately 2°. The loft angle θ may also correspond to the angle of the front face 32 of the base member 24 (with the putter head at a ball address position) with respect to a vertical line VL. As further shown in FIG. 5, the putter head 12 may also have a bounce angle β wherein a rear portion of the putter head 12 angles upwardly from a horizontal plane. The bounce angle β may vary and could be 3° or less. In one exemplary embodiment, the bounce angle β is approximately 1.5°. An angle α is also defined between the face and sole of the putter head. In one exemplary embodiment, the angle α is approximately 86.5° which angle can vary based on the loft and bounce characteristics of the putter head 12.

In some examples, the insert 38 may be removable to allow for replacement, customization, and/or personalization of the insert 38 and/or putter head 12. For instance, the insert 38 may be releasably connected to the putter body 20 using mechanical connectors to secure the insert 38 in the recess 36. Finally, it is further understood that the structures and features of the insert 38 could be integrally formed in the putter body 20 if desired. A sensor(s) could also be associated with the insert 38 or other portions of the putter body 20. The sensor(s) is used to record data regarding movement and impact of the putter head 12.

According to aspects of the disclosure, and referring generally to FIGS. 2-8, the arms 26,28 may define at least a portion of the sides of putter head 12. The arms 26,28 may be configured to connect the base member 24 of the putter head 20 with the weight assembly 22. Each of the arms 26,28 may extend in a linear straight line, although other non-linear configurations are possible.

As shown in FIGS. 2-3, the first arm 26 extends away from the base member 24. As further discussed, in an exemplary embodiment, the first arm 26 extends at an angle with respect to the base member 24. The first arm 26 has a proximal end 60 generally proximate the base member 24 and a distal end 62 remote from the base member 24. In an exemplary embodiment, the proximal end 60 adjoins with the first tapered portion 44. The first arm 26 has an intermediate portion 64 extending between the proximal end 60 and the distal end 62. The intermediate portion 64 has a generally linear configuration in an exemplary embodiment. The first arm 26 has a first aperture 66 therethrough at the intermediate portion 64. The first aperture 66 extends completely through the first arm 26 in an exemplary embodiment although the first aperture 66 could only extend into a portion of the first arm 26. The first aperture 66 defines a removed weight portion wherein overall weight of the putter head 12 can be repositioned as desired. In an exemplary embodiment, the first aperture 66 can extend into the first tapered portion 44.

Figure 13:
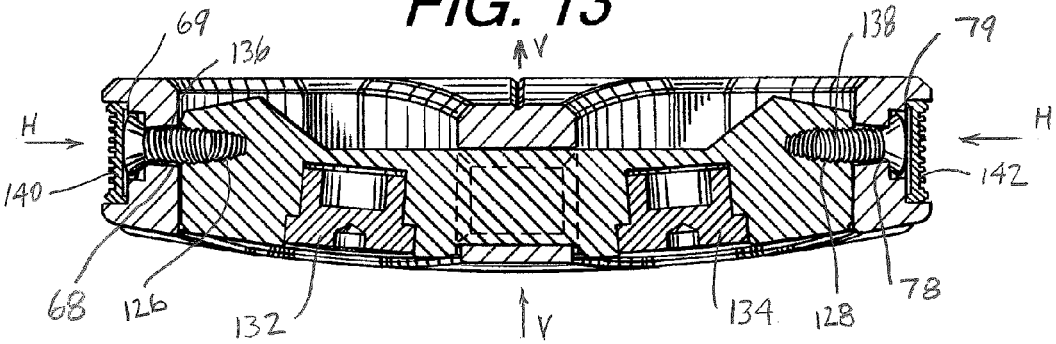
FIG. 13 is a cross-sectional view of the putter head taken along line 13-13 of FIG. 6, and shown inverted in FIG. 13.

As also shown in FIGS. 7 and 13, the first arm 26 further has a first opening 68 therethrough at the distal end 62. The first opening 68 is a threaded opening and generally extends along a horizontal plane when the putter head 12 is at a ball address position. The first opening 68 extends generally horizontally from a side of the putter head 12 towards the central member 30. The first arm 26 also defines a first platform 69 around the first opening 68. As explained in greater detail below, the first opening 68 and first platform 69 will cooperate with a fastener and cover member when supporting and connecting the weight assembly 22 to the putter body 20.

As further shown in FIGS. 2-3 and similar to the first arm 26, the second arm 28 extends away from the base member 24. As further discussed, in an exemplary embodiment, the second arm 28 extends at an angle with respect to the base member 24. The second arm 28 has a proximal end 70 generally proximate the base member 24 and a distal end 72 remote from the base member 24. In an exemplary embodiment, the proximal end 70 adjoins with the second tapered portion 46. The second arm 28 has an intermediate portion 74 extending between the proximal end 70 and the distal end 72. The intermediate portion 74 has a generally linear configuration in an exemplary embodiment. The second arm 28 has a second aperture 76 therethrough at the intermediate portion 74. The second aperture 76 defines a removed weight portion wherein overall weight of the putter head 12 can be repositioned as desired. The second aperture 76 extends completely through the second arm 28 in an exemplary embodiment although the second aperture 76 could only extend into a portion of the second arm 28. In an exemplary embodiment, the second aperture 76 can extend into the second tapered portion 46.

As also shown in FIGS. 7 and 13, the second arm 28 further has a second opening 78 therethrough at the distal end 72. The second opening 78 is a threaded opening and generally extends along a horizontal plane when the putter head 12 is at a ball address position. The second opening 78 extends generally horizontally from a side of the putter head 12 towards the central member 30. The second arm 28 also defines a second platform 79 around the second opening 78. As explained in greater detail below, the second opening 78 and second platform 79 will cooperate with a fastener and cover member when supporting and connecting the weight assembly 22 to the putter body 20.

As seen in FIG. 3, the arms 26,28 may be configured to extend inwardly such as to taper the width of the putter head 12 (when viewed from above) as the putter head 12 extends from a rear portion to the base member 24. Conversely, the arms 26,28 extend outwardly from the base member 24. Further, the arms 26,28 may be symmetrical with each other relative to the center line CL of the putter head 12.

As discussed and further seen in FIGS. 2-3, the arms 26,28 may be configured such that they meet with the tapered portions 44,46 of the base member 24. Further, the point where the arms 26,28 meet with the tapered portions 44,46 may define a bend or curve which creates an angle that faces away from the central member 30 of the putter head 12. For example, the first arm 26 and the first tapered portion 44 of the base member 24 may be configured such that they define an obtuse angle which faces away from the central member 30 of the putter head 12. According to particular examples of the disclosure, the angle may be approximately 145°. According to other examples, the angle may range between 95°-175°, 120°-170°, 130°-160°, 140°-150°. The second arm 28 and the second tapered portion 46 of the base member 24 may have a similar structure and symmetrical orientation. The angles on each side could also be different if desired.

Figure 16:
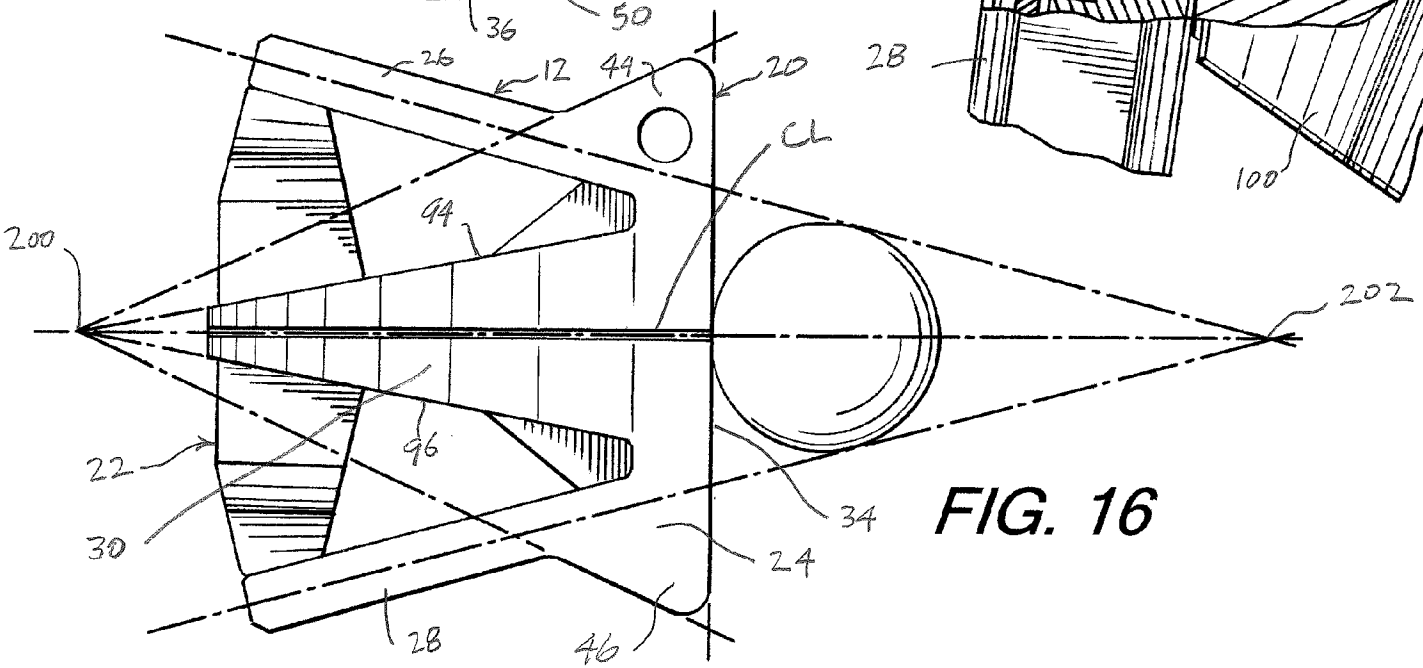
FIG. 16 is a top plan view of the putter head of FIG. 2 with a golf ball and extensions of lines (shown by dashed lines) defined by the putter head used as alignment aids.

According to aspects of the disclosure, and as seen in FIGS. 3 and 16, the arms 26,28 may be configured such that they are angled towards the center line CL of the putter head 12 in a way that the center line of each of the arms 26,28 will extend to outline or frame a golf ball when the golf ball is positioned in front of the ball striking face surface 34 such that the center of the golf ball is aligned with the center of the ball striking face surface 34. For example, the center line of each arm 26,28 is configured such that it would extend from the structure of putter head 12 such that the lines are tangent to a portion of the golf ball along the outside diameter of the golf ball when the golf ball is aligned with the putter head such that the center of the putter head is aligned with a center of golf ball at an address position. Such geometric features will be further described below.

It is further understood that the arms 26,28 could extend directly away from the base member 24 such as if the tapered portions 44,46 were eliminated. The tapered portions 44,46 could also be considered to be a portion of the arms 26,28 in alternative embodiments.

As further shown in FIGS. 2-8, the central member 30 extends away from the base member 24 and is positioned between the first arm 26 and the second arm 28. The central member 30 has a proximal end 80 generally at the base member 24 and a distal end 82 remote from the base member 24. An intermediate portion 84 extends between the proximal end 80 and the distal end 82. At the distal end 82, the central member 30 has a first segment 86 and a second segment 88 that define a space S therebetween. The first segment 86 is generally at a bottom of the putter head 12 and the second segment 88 is generally at a top of the putter head 12. The central member 30 further has a vertical wall 90 extending between the first segment 86 and the second segment 88. Accordingly, with these structures, the central member 30 defines generally a C-shaped channel at the distal end 82. The space S is configured to receive a portion of the weight assembly 22. The segments 86,88 define surfaces to support the weight assembly generally along a vertical plane as will be described in greater detail below.

As further shown in FIGS. 2 and 3, the central member 30 also has a top surface 92 that has a center line CL that cooperates with and corresponds to the center line CL on the base member 24. The central member 30 has a longitudinal axis that coincides with the center line CL. Further, the longitudinal axis of the central member 30 may be substantially perpendicular to a longitudinal axis of the base member 24. The central member 30 further has a first lateral side 94 and a second lateral side 96. The lateral sides 94,96 taper towards one another and towards the center line CL as the central member 30 extends from the base member 24 towards the rear of the putter body 12.

A further shown in FIG. 3, according to aspects of the disclosure, one or more passageways 98 may be defined in the putter body 12. The passageways 98 may be positioned on either side of the central member 30 of the putter head 12. In particular, one passageway 98 is defined between the first arm 26 and the first lateral side 94 of the central member 30. Another passageway 98 is defined between the second arm 28 and the second lateral side 96 of the central member 30. It is understood that the putter head 12 could include a bottom floor member wherein the passageways 98 do not extend completely through the putter body 12. Further, the passageways may be symmetrical to each other with respect to the center line CL of the putter head 12.

Weight Assembly

As further shown in FIGS. 2-10, the weight assembly 22 generally includes a beam member 100 capable of supporting a plurality of weight members 101. The beam member 100 can be made from a variety of different materials including metal members including stainless steel. The weight members 101 can also be made of various materials including metal-based members, and also polymer-based members or some combination of such materials or other materials. The weight assembly 22 is operably associated with the putter body 20 as described further below.

As shown in FIGS. 7-10, the beam member 100 is generally a box-like structure having a first end 102 and a second end 104 and a central portion 106 therebetween. The beam member 100 further has a front surface 108, a rear surface 110, a top surface 112 and a bottom surface 114. The beam member 100 has a length that generally corresponds to a gap defined between the respective distal ends 62,72 of the first arm 26 and the second arm 28. The front surface 108 has an opening therein and in communication with a central receptacle 116 or central port 116. The central receptacle 116 is dimensioned to receive a weight member 101 as described further. The rear surface 110 is generally a planar vertical surface, which may have identifying indicia thereon such as a logo etc.

The top surface 112 has a plurality of segments at different heights such as when the putter head 12 is at a ball address position. For example, a segment of the beam member 100 at the central portion 106 is at a lower height than segments at the ends of the beam member 100. The top surface 112 further has inclined segments between the central segment and the ends. As shown in FIG. 7, the bottom surface 114 has a recess 118 generally at the central segment of the beam member 100. The recess 118 has tapered edges 120. The bottom surface 114 further has first receptacle 122, or first weight port 122, positioned between the first end 102 and the recess 118. The bottom surface 114 also has a second receptacle 124, or second weight port 124, positioned between the second end 104 and the recess 118. The first receptacle 122 and the second receptacle 124 do not pass completely through the beam member 100 in an exemplary embodiment. Also in an exemplary embodiment, the first receptacle 122 and the second receptacle 124 may be threaded to receive a corresponding threaded weight member as will be described.

Figure 9:
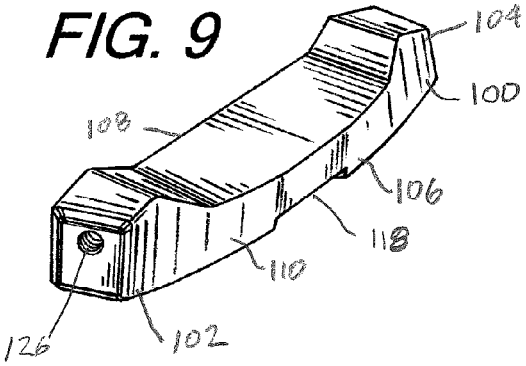
FIG. 9 is a perspective view of a beam member of a weight assembly of the putter head of FIG. 2.
Figure 11:
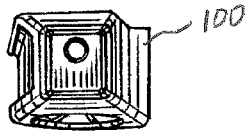
FIG. 11 is a side elevation view of the beam member of FIG. 9.
Figure 10:
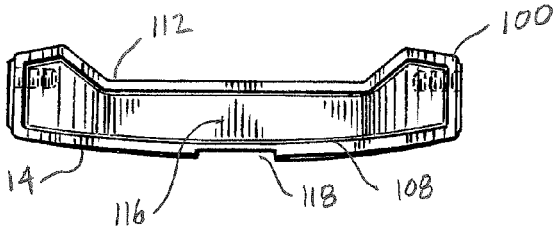
FIG. 10 is a front elevation view of the beam member of FIG. 9.

As further shown in FIGS. 7 and 9, the first end 102 of the beam member 100 has a first opening 126 that extends generally along the horizontal plane through a vertical end surface of the beam member 100. The second end 104 of the beam member 100 has a second opening 128 that extends generally along the horizontal plane through a vertical end surface of the beam member 100. The first opening 126 and the second opening 128 are threaded openings in an exemplary embodiment.

As further shown in FIG. 7, the weight assembly 22 has the plurality of weight members 101 operably associated therewith. It is understood that the beam member 100 is a weight member itself. In an exemplary embodiment, the weight assembly 22 has a central weight member 130 that is dimensioned to be received in the central receptacle 116. The central weight member 130 may be a steel member in an exemplary embodiment although other materials could be used. FIG. 7 shows a steel weight member 130 as well as a polymer-based weight member 130 wherein one of the weight members can be selected to be inserted into the central receptacle 116 depending on the design of the putter head 12. The central weight member 130 may be formed in a box-like shape and dimensioned to fit within the central receptacle 116 of the beam member 110. The weight assembly 22 also has a first weight member 132 and a second weight member 134. The first weight member 132 is dimensioned to be received by the first receptacle 122 and the second weight member 134 is dimensioned to be received by the second receptacle 124. The weight members 132, 134 are threaded in an exemplary embodiment. Thus, the weight members 132,134 can be removed and replaced with other weight members 132,134 having different weight values or other characteristics. The weight members 132,134 can be made from a variety of materials such as tungsten, or a combination of tungsten embedded in other materials. It is understood that the weight members 132,134 can vary in shape and materials used. Other fastening mechanisms can also be used to secure the weight members 132,134 in the receptacles 122,124. It is further understood that the beam member 100 may have a significant weight value and thus be considered a further weight member. The beam member 100 could also be constructed from multiple parts having different weight values or from an integral member having weight concentrated at specific segments of the member. For example, weight could be concentrated at ends of the beam member 100 in relation to the central portion of the beam member 100. It is further understood that the weight members could be removed from the beam member 100 (e.g., at the central receptacle or first or second receptacle) and not used in certain embodiments, or extreme lightweight members could be inserted into the receptacles that do not add any significant weight to the putter head 12.

Connection Between Putter Body and Weight Assembly

Aspects of the present invention include methods of forming the putter. Thus, it is understood that the putter body 20, weight assembly 22 as well as the shaft 16 may be formed by manufacturing processes known by those skilled in the art. For example, the putter body 20 may be machined or otherwise formed as an integral member and the insert 38 may also be manufactured using known methods. The insert 38 is inserted into the recess 36 and secured therein using various fastening mechanisms as desired. The weight assembly 22 is prepared wherein a desired central weight member 130 is positioned in the central receptacle 116. In an exemplary embodiment, the central weight member 130 is adhered in the central receptacle 116 via an adhesive. The first weight member 132 is inserted into and secured in the first receptacle 122 and the second weight member 134 is inserted into and secured in the second receptacle 124.

As further can be appreciated from FIGS. 2-8 and 12-14, the weight assembly 22 is operably connected to and supported by the putter body 20. The weight assembly 22 is supported along multiple planes and directions to provide an enhanced connection structure and overall enhanced structural configuration of the putter 10. The connection structure includes a first threaded fastener 136 associated with the first arm 26 and first end 102 of the beam member 100 and a second threaded fastener 138 associated with the second arm 28 and the second end 104 of the beam member 100. The weight assembly 22 is inserted into the central member 30. As can be further appreciated from FIGS. 7-8 and 12-13, the first segment 86 of the central member 30 connects and provides support to the weight assembly 22 along the first plane, or vertical plane V. The first segment 86 is received in the recess 118 on the bottom surface 114 of the beam member 100. In an exemplary embodiment, edges of the first segment 86 are generally flush the tapered edges 120 defined by the recess 118. Thus, the first segment 86 provides an upward support force to the weight assembly 22. Further, the second segment 88 of the central member 30 is positioned over the top surface 112 of the beam member 100 providing further connection and support along the vertical plane V. Thus, the first segment 86 and the second segment 88 of the central member 30 sandwich the central portion 106 of the beam member 100. If desired, the segments 86,88 could be structured so as to provide an interference fit with the beam member 100. It is further appreciated from FIGS. 7 and 12, that the central weight member 130 confronts the vertical wall 90 of the central member 30 to substantially encase the central weight member 130.

Figure 14:
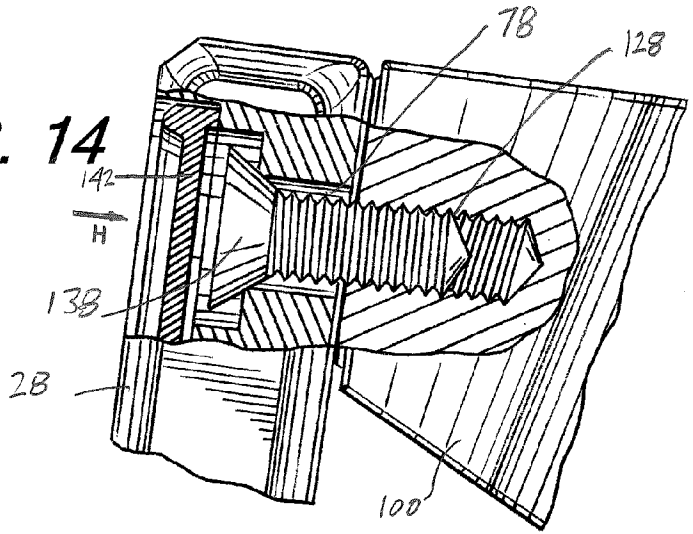
FIG. 14 is a partial cross-sectional view showing a connection of the beam member to an arm of the putter head.

As further shown in FIGS. 6-8 and 13-14, the first arm 26 is connected to the weight assembly 22. The first fastener 136 is received through the first opening 68 of the first arm 26 and along the second plane, or horizontal plane H and into the first opening 126 in the beam member 100. Adhesive may be applied to the first fastener 136 prior to insertion into the openings if desired. The first fastener 136 is tightened accordingly to provide a secure connection between the first arm 26 and the beam member 100. As further shown in FIGS. 7 and 13, a first badge member 140 is provided and positioned on the first platform 69 and over the first fastener 136. The first badge member 140 may be secured to the first arm 26 via adhesive or other type of fastening mechanism. Similarly, the second arm 28 is also connected to the weight assembly 22. The second fastener 138 is received through the second opening 78 of the second arm 28 and also along the second plane, or horizontal plane H and into the second opening 128 in the beam member 100. Adhesive may be applied to the second fastener 138 prior to insertion into the openings if desired. The second fastener 138 is tightened accordingly to provide a secure connection between the second arm 28 and the beam member 100. As further shown in FIGS. 7 and 13, a second badge member 142 is provided and positioned on the first platform 79 and over the second fastener 138. The second badge member 142 may be secured to the second arm 28 via adhesive or other type of fastening mechanism. FIG. 14 shows an enlarged view of this connection and it is understood that the connection at the first arm 26 is similar. It can be appreciated that the connection between the arms 26,28 and the beam member 100 of the weight assembly 22 is along the horizontal plane H, or a horizontal direction such as when the putter head 12 is at a ball address position.

Thus, as can be further appreciated from FIGS. 2-3, 7-8 and 12-14, the weight assembly 22 is secured to and supported by the putter body 20 in multiple planes and directions to provide an enhanced structural connection configuration. The weight assembly 22 is secured to and supported by the putter body 20 in a first plane and first direction and a second plane and second direction. In an exemplary embodiment, the second plane/second direction is generally transverse to the first plane/first direction. Also in an exemplary embodiment, the first plane and first direction is generally vertical. The first segment 86 and second segment 88 of the central member 30 secures and supports the weight assembly 22 along the vertical plane V and in a vertical direction. The first fastener 136 and the second fastener 138 secures and supports the weight assembly 22 along the horizontal plane H and in a horizontal direction. The horizontal plane H is generally transverse to the vertical plane V in an exemplary embodiment. It is understood that the planes and directions could be set in additional configurations with respect to one another.

It is understood that while the ends 102,104 of the beam member 100 are connected to the arms 26,28 using threaded fasteners, other connection mechanisms are also possible. For example, snap-fit mechanisms or other interference fit type connections could be provided. It is further understood that the planes and directions of the connections could also be reversed or altered. For example, the connection at the central portion 106 of the beam member 100 could be along the horizontal plane H while the connections at the ends 102,104 of the beam member 100 could be along the vertical plane V. Other connection configurations at the central member 30 could also be employed.

The structural configuration of the putter 10 allows for further customization such as moving the center of gravity CG more towards the rear of the putter head. In an exemplary embodiment, the putter body 20 is formed from a lighter weight material such as aluminum. Additional components such as the face insert 38 or badge members 140,142 do not add significant weight. The weight assembly 22 is constructed from more dense and heavier materials. As the weight assembly 22 is supported at the rear of the putter body 20, the CG is positioned more towards the rear. In certain exemplary embodiments, the putter head 12 has a total weight value and the weight assembly 22 has a weight value that may be approximately 40%-60% of the total weight value of the putter head 12. In a particular example, the putter head 12 has a total weight value of approximately 390 g and the weight assembly 22 has a weight value of approximately 206 g. This configuration may be utilized in a belly-type putter. In another particular example, the putter head 12 has a total weight value of approximately 365 g and the weight assembly has a weight value of 206 g. In a further particular example, the putter head 12 has a total weight value of approximately 350 g and the weight assembly has a weight value of 206 g. In further exemplary embodiments, the weight assembly 22 could also have a weight value of approximately 169 g. Different combinations of weight values between the putter body and weight assembly are possible. As discussed, the CG may be moved more towards the rear of the putter head. The putter head may have a breadth dimension generally from the ball striking face surface 34 to the rear most portion of the putter head. In certain particular embodiments, the CG of the putter head may be located at approximately 25% of the breadth when measured from the ball striking face surface. In certain other particular embodiments, the CG of the putter head may be located at approximately 50% of the breadth when measured from the ball striking face surface. In certain other particular embodiments, the CG of the putter head may be located at approximately 75% of the breadth when measured from the ball striking face surface.

Geometric Features

According to additional aspects of the disclosure, the golf club putter head 12 is configured to improve alignment through its geometric design. For example, according to aspects of the disclosure, portions of the putter head 12 are configured to draw the eye forward towards the ball. Further, portions of the putter head 12 are configured to draw the eye rearward toward a point in space behind the putter head 12 (e.g., a point in space behind the putter head that is in line with the center line of the putter head, and, thereby, a point in line with the center of a golf ball, when the golf ball is positioned in front of the ball striking face such that the center of the golf ball is aligned with the center of the ball striking face). Such features of the putter head structure create converging geometric cues that allow the human eye to more accurately perceive alignment between the putter head and the golf ball and, also, to more accurately perceive misalignment between the putter head and the golf ball.

According to aspects of the disclosure, elements of the structure of the putter head 12 may be arranged such that the elements (or portions thereof) define lines that help the golfer determine whether the putter is in proper alignment (or misaligned) with the golf ball. For example, the putter head 12 may be configured to exhibit multiple design lines, wherein extensions of such design lines converge at specific points. For example, the putter head 12 may be configured such that lines which extend from the structure of putter head converge at a given point in space. In one embodiment, lines which extend from the structure of putter head 12 converge at a given point in space behind the putter head 12. According to aspects of the disclosure, the given point in space behind the putter head 12 at which the lines converge may be in line with a center line of the putter head 12 (i.e., a line extending rearwards from the center line of the putter head 12 would also intersect the given point in space behind the putter head 12).

Additionally, extensions from the lines which are defined by the elements of the putter head 12 may outline or frame a golf ball when the golf ball is positioned in front of the ball striking face surface 34 such that the center of the golf ball is aligned with the center of the ball striking face surface 34. For example, lines which extend from the structure of the putter head 12 may extend such that the lines are tangent to a portion of the golf ball along the outside diameter of a golf ball when the golf ball is aligned with the putter head 12 such that the center of the putter head 12 is aligned with a center of the golf ball at an address position. As discussed in detail below, the above described features can aid the golfer in determining whether the putter is properly aligned (or misaligned) with the golf ball.

In particular and as can be appreciated from FIG. 16, the geometric design of the putter head 12 may be configured to draw the eye forward towards the ball. Further, the geometric design of the putter head 12 may be also configured to draw the eye rearward toward a point in space behind the putter head 12 (e.g., a point in space behind the putter head 12 that is in line with the center line of the putter head 12). Such features of the putter head 12 create converging geometric cues that allow the human eye to more accurately perceive alignment between the putter head and the golf ball and, also, misalignment between the putter head and the golf ball.

Specifically, the putter head 12 may be configured to exhibit multiple design lines, wherein extensions of such design lines converge at specific points. For example, the above described elements of the structure of putter head 12 may be arranged such that the elements (or portions thereof) define lines that help the golfer determine whether the putter is properly aligned (or misaligned) with the golf ball. For example, extensions from the lines which are defined by the elements of the putter head 12 may outline or frame the golf ball. This can aid the golfer to determine whether the putter is properly alignment (or misaligned) with the golf ball.

Additionally, extensions from the lines defined by the elements of the putter head 12 may converge at a given point in space. For example, in the illustrative embodiment shown in FIG. 16, extensions from the lines which are defined by the elements of the putter head 12 converge at a given point in space behind the putter head 12 which is in line with the center line of the putter head 12. This can aid the golfer determine whether the putter is properly aligned (or misaligned) with the golf ball.

Therefore, such design lines of the current disclosure surround and frame the golf ball in the front of the putter head 12 and, also, create a convergence point in space behind the putter head 12, which is aligned with the center line CL. Hence, the combination of such design lines can create converging geometric cues that allow the human eye to more accurately perceive alignment between the putter head and the golf ball and, also, misalignment between the putter head and the golf ball.

Such design lines will be described in detail below and with respect to FIG. 16 which illustrates the extensions of the lines and, also, the points where one or more of the lines converge.

As seen in FIG. 16, the illustrative putter head 12 includes a central alignment aid which points in the intended target direction and aligns with the heel-to-toe center of the base member 24 and ball striking face surface 34. This central alignment aid is aligned with the center line CL of the putter head 12. This central alignment aid may be provided on a top surface of the main body portion of the putter head 12. Further, as seen in FIG. 16, the extension of the center line CL of the putter head 12 is shown in dashed lines. In FIG. 16, the putter head 12 is shown along with a golf ball that has been positioned in front of the ball striking member surface 34 with the center of the golf ball aligned with the center line CL of the putter head 12. Accordingly, as seen in FIG. 16, the extension of the center line CL extends through a center of a golf ball and rearwardly to a convergence point 200.

According to aspects of the disclosure, the arms of the putter head 12 may be configured to act as another alignment aid. For example, as seen by the dashed lines in FIG. 16, lines which extend from each of centerlines of the arms 26,28 may converge at a given point in space 202 in front of the golf ball when the golf ball is positioned as described above. As seen in FIG. 16, such lines are symmetrical to each other with regard to the center line CL of the putter head 12. Further, it is noted that these lines extend such that the lines are tangent to a portion of the golf ball along the outside diameter of the golf ball when the golf ball is positioned as described above. In other words, the lines frame or outline the golf ball. This feature can aid the golfer in determining whether the putter is properly aligned (or misaligned) with the golf ball.

According to aspects of the disclosure, the two flared or tapered portions 44,46 of the base member 24, which extend rearwardly away from the front face 34 of the base member 24 may be configured to act as another alignment aid. As seen by the dashed lines in FIG. 16, lines which extend from each of the outer sides of the flared or tapered portions 44,46 of the base member 24 may converge to the given point in space 200 behind putter head 12. Such lines are symmetrical to each other with regard to the center line CL of the putter head 12. Further, this convergence point 200 behind the putter head 12 is aligned with a center line CL of the putter head 12. This feature can aid the golfer in determining whether the putter is properly alignment (or misaligned) with the golf ball.

According to additional aspects of the disclosure, the central member 30 may be configured to act as another alignment aid. For example, the center portion of the central member 30 may be configured to act as an alignment aid. Lines which extend from each of the symmetrical boundaries defined by sides 94,96 of the central member 30, are symmetrical to each other with regard to the center line CL of the putter head 12. Further, these lines extend such that the lines may outline the golf ball when the golf ball is positioned as described above. In other words, the lines can generally frame the golf ball. This feature can aid the golfer in determining whether the putter is properly aligned (or misaligned) with the golf ball. As further shown in FIG. 16, the lines that extend from the sides 94,96 of the central member 30 may also converge to the given point in space 200 behind the putter head 12.

While each of the above described features alone can aid the golfer in determining whether the putter is properly aligned (or misaligned) with the golf ball, as seen in FIG. 16, each of the above discussed alignment aids can be combined to provide an improved overall or composite alignment aid effect. In other words, the above discussed alignment aids may be visually tied together and/or work in manners that complement one another.

Accordingly, the putter head 12 improves alignment through its geometric design. The putter head 12 creates converging geometric cues that allow the human eye to more accurately perceive alignment between the putter head and the golf ball and, also, misalignment between the putter head and the golf ball. Specifically, extensions from the lines which are defined by the elements of the putter head 12 may outline or frame the golf ball. Additionally, extensions from the lines defined by the elements of the putter head 12 may converge at a given point in space 200 behind the putter head 12 which is in line with the center line CL of the putter head 12. These features can aid the golfer to determine whether the putter is properly aligned (or misaligned) with the golf ball. Hence, the combination of such design lines can create converging geometric cues that allow the human eye to more accurately perceive alignment between the putter head and the golf ball and, also, misalignment between the putter head and the golf ball.

It is noted that, if desired, the putter head 12 may include other alignment aids associated with the putter head 12 including alignment aids that may be associated specifically with the putter body 20 and/or the weight assembly 22.

Putters and putter heads may have any desired constructions, materials, dimensions, loft angles, lie angles, colors, designs, and the like without departing from this invention, including conventional constructions, materials, dimensions, loft angles, lie angles, colors, designs, and the like, as are known and used in the art.

The putter and putter head described herein provide several benefits. The unique securing structure between the putter body and the weight assembly provides securement and support in multiple planes and directions. Such configuration provides for a firm and rigid connection that enhances the overall feel of the putter while allowing for other desired performance characteristics. For example, the configuration of the weight assembly on the putter head provides for a center of gravity (CG) that is located more towards the rear of the putter head. Such features also cooperate with the face insert to provide for enhanced rolling of the golf ball during a putt. Material selection and construction further provides desired weight and density ratios between the putter body and weight assembly to provide enhanced performance characteristics relating to at least CG and moment of inertia (MOI). Additional weighting options among the various weight receptacles/ports and weight members used allow for further customization to achieve desired performance characteristics. Thus, the structural configuration of the putter head allows for improved putter head balance, desired location of the CG location, which can also affect the MOI of the putter head (particularly about the vertical or Z-axis located at the club head's center of gravity (Izz)). With such configurations, the overall feel of the putter head is enhanced. The geometric design of the putter head further provides for enhanced alignment aids for the golfer.

CONCLUSION

Of course, many modifications to the putter and putter head structures and/or methods for making these structures may be used without departing from the invention. For example, with respect to the structures, grips, aiming indicia or markings, other indicia or markings, different types of putter heads, various shaft curvatures and/or shapes, various shaft connecting member shapes, and/or other structural elements may be provided and/or modified in the structure without departing from the invention. With respect to the methods, additional production steps may be added, various described steps may be omitted, the steps may be changed and/or changed in order, and the like, without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

We claim:

1. A putter head comprising:

a putter body having a base member defining a ball striking face surface, the putter body further having a first arm extending away from the base member and a second arm extending away from the base member, the putter body further having a central member extending away from the base member and positioned between the first arm and the second arm; and a weight assembly supported by the putter body, the weight assembly having a beam member having a first end and a second end, the beam member further having a central portion, the central portion being supported by the central member along a first plane, and wherein the first end of the beam member is supported by the first arm along a second plane, the second plane being generally transverse to the first plane; and wherein the central member has a first segment and a second segment defining a space therebetween, wherein the central portion is received in the space.

2. The putter head of claim 1 wherein the first plane is a generally vertical plane when the putter head is at a ball address position and wherein the second plane is generally a horizontal plane when the putter head is at the ball address position.

3. The putter head of claim 1 wherein the central member defines a C-shaped channel, the central portion of the beam member received in the C-shaped channel.

4. The putter head of claim 1 wherein the central portion is received in the space in an interference fit between the first segment and the second segment.

5. The putter head of claim 1, further having a wall extending between the first segment and the second segment, the beam member having a receptacle having a weight member therein, wherein the central portion is received in the space wherein the weight member confronts the wall.

6. The putter head of claim 1 wherein a bottom surface of the beam member has a recess proximate the central portion, wherein the first segment is received in the recess wherein edges defined by the recess and edges defined by the first segment are generally flush with one another.

7. The putter head of claim 1 wherein the first segment is positioned against a bottom surface of the beam member and the second segment is positioned against a top surface of the beam member.

8. The putter head of claim 1 wherein the second end of the beam member is supported by the second arm along the second plane.

9. The putter head of claim 1 wherein the first arm has a first opening at a distal end and extending along the second plane, the second plane being a generally horizontal plane when the putter head is at a ball address position, the second arm having a second opening at a distal end and extending along the second plane.

10. The putter head of claim 9 wherein the beam member has a first opening at the first end extending along the second plane, the beam member having a second opening at the second end extending along the second plane.

11. The putter head of claim 10 wherein a first fastener is received through the first opening of the first arm and the first opening of the beam member along the second plane, and wherein a second fastener is received through the second opening of the second arm and the second opening of the beam member along the second plane.

12. The putter head of claim 11 wherein the first arm defines a first platform around the first opening and the second arm defines a second platform around the second opening, and further comprising a first badge member positioned over the first fastener on the first platform and a second badge member positioned over the second fastener on the second platform.

13. The putter head of claim 1 wherein the beam member has a receptacle, the receptacle receiving a weight member therein.

14. The putter head of claim 1 wherein the beam member has a central receptacle, the beam member further having a first receptacle adjacent the central receptacle and a second receptacle adjacent the central receptacle opposite from the first receptacle, wherein a central weight member is positioned in the central receptacle, a first weight member is positioned in the first receptacle and a second weight member is positioned in the second receptacle.

15. The putter head of claim 14 wherein the central weight member is received in the central receptacle from a front segment of the beam member.

16. The putter head of claim 14 wherein the first weight member is received in the first receptacle from a bottom surface of the beam member, and the second weight member is received in the second receptacle from the bottom surface of the beam member.

17. The putter head of claim 16 wherein the first receptacle and the first weight member have mating threads to secure the first weight member in the first receptacle and the second receptacle and the second weight member have mating threads to secure the second weight member in the second receptacle.

18. The putter head of claim 1 wherein the putter head has a total weight value and the weight assembly has a weight value that is approximately 50%-60% of the total weight value of the putter head.

19. The putter head of claim 1 wherein the base member has a recess therein, the recess receiving a ball striking face insert, the insert having a front portion formed of a metal material and having a plurality of spaced apart openings formed in the metal material, and a backing material engaged with the front portion, the backing material being formed of a polymer material, the polymer material extending into the openings wherein the metal material and polymer material form at least a portion of the ball striking face surface of the putter head.

20. The putter head of claim 1 wherein a center line is defined through the ball striking face surface, wherein the first arm is configured to be angled towards the center line of the putter head such that the first arm defines a first line which, when extended, is tangent to a portion of an outside diameter of a golf ball when the golf ball is positioned in front of the ball striking face surface with the center of the golf ball aligned with the center line of the putter head, and wherein the second arm is configured to be angled towards the center line of the putter head such that the second arm defines a second line which, when extended, is tangent to a portion of an outside diameter of the golf ball when the golf ball is positioned in front of the ball striking face surface with the center of the golf ball aligned with the center line of the putter head.

21. A putter head according to claim 20, wherein the first line extends linearly throughout the first arm along a linear center line of the first arm and the second line extends linearly throughout the second arm along a linear center line of the second arm, wherein the first line and the second line are symmetrical with respect to the center line of the putter head.

22. The putter head of claim 1 wherein the putter body defines a center line through the ball striking face surface, the putter body further having a first structure defining a first pair of lines that, when extended to a position in front of the ball striking face surface, the lines are generally tangent to respective opposite portions of an outside diameter of the golf ball when the golf ball is positioned in front of the ball striking face surface with the center of the golf ball aligned with the center line of the putter head, the putter body further having a second structure defining a second pair of lines that, when extended, converge to a point in space behind the putter head that is aligned with the center line of the putter head.

23. A putter head comprising:

a putter body; and a weight assembly operably associated with the putter body, wherein the weight assembly is connected to the putter body at a first location of the putter body and generally along a first direction and wherein the weight assembly is connected to the putter body at a second location of the putter body and generally along a second direction, the second direction being generally transverse to the first direction;

wherein the putter body has a central member having a first segment and a second segment defining a space therebetween, wherein a central portion of the weight assembly is received in the space to define the connection at the first location and wherein the first direction is generally vertical when the putter head is in a ball address position; and wherein the putter body has a first arm and a second arm, the weight assembly having a first end and a second end, the first arm connected to the first end of the weight assembly and the second arm connected to the second end of the weight assembly to define the second location and wherein the second direction is generally horizontal when the putter head is in a ball address position.

24. A putter head comprising:

a putter body having a base member defining a ball striking face surface, the putter body further having a first arm extending away from the base member and a second arm extending away from the base member, the first arm having a first opening at a distal end and extending along a generally horizontal plane when the putter head is at a ball address position, the second arm having a second opening at a distal end and extending along the generally horizontal plane when the putter head is at the ball address position, the putter body further having a central member extending away from the base member and positioned between the first arm and the second arm, the central member having a first segment and a second segment defining a space therebetween;

a weight assembly supported by the putter body, the weight assembly comprising:

a beam member having a central portion, the beam member having a first opening at a first end extending along the generally horizontal plane when the putter head is at the ball address position, the beam member having a second opening at a second end extending along the generally horizontal plane when the putter head is at the ball address position, the beam member having a central receptacle, the beam member further having a first receptacle adjacent the central receptacle and a second receptacle adjacent the central receptacle opposite from the first receptacle;

a central weight member positioned in the central receptacle;

a first weight member positioned in the first receptacle;

a second weight member positioned in the second receptacle, wherein the beam member is positioned in the space between the first segment and the second segment wherein the central portion of the beam member is supported along a generally vertical plane, and wherein a first fastener is received through the first opening of the first arm and the first opening of the beam member along the horizontal plane, and wherein a second fastener is received through the second opening of the second arm and the second opening of the beam member along the horizontal plane, the horizontal plane being generally transverse to the vertical plane.

* * * * *